US007255619B2

(12) United States Patent
Rasmussen

(10) Patent No.: US 7,255,619 B2
(45) Date of Patent: Aug. 14, 2007

(54) VARIABLE RESISTANCE AQUATIC DEVICE AND METHODS OF USING THE SAME

(76) Inventor: Scott K. Rasmussen, 1558 Rosewood Blvd., Avon, OH (US) 44011

( * ) Notice: Subject to any disclaimer, the term of this patent is extended or adjusted under 35 U.S.C. 154(b) by 0 days.

(21) Appl. No.: 11/256,680

(22) Filed: Oct. 21, 2005

(65) Prior Publication Data

US 2007/0093153 A1 Apr. 26, 2007

(51) Int. Cl.
*A63B 31/08* (2006.01)

(52) U.S. Cl. ..... 441/64

(58) Field of Classification Search ..... D21/806; 441/64, 61, 62; 482/111
See application file for complete search history.

(56) References Cited

U.S. PATENT DOCUMENTS

| | | | | |
|---|---|---|---|---|
| 1,745,280 | A | 1/1930 | Snapp | |
| 2,094,532 | A | 9/1937 | Glad | 9/21 |
| 3,082,442 | A * | 3/1963 | Cousteau et al. | 441/64 |
| 3,084,355 | A | 4/1963 | Ciccotelli | 9/304 |
| 3,424,133 | A | 1/1969 | Brady | 119/29 |
| 3,427,022 | A | 2/1969 | Ward | 272/80 |
| 4,300,759 | A | 11/1981 | Caplan | 272/116 |
| 4,458,896 | A | 7/1984 | Solloway | 272/116 |
| 4,756,699 | A | 7/1988 | Brom | 441/59 |
| 4,813,668 | A | 3/1989 | Solloway | 272/116 |
| 4,973,049 | A | 11/1990 | Ciolino | 272/116 |
| 4,988,094 | A | 1/1991 | Beasley | 272/116 |
| 5,102,120 | A | 4/1992 | Lindblad | 482/111 |
| 5,338,275 | A | 8/1994 | Chek | 482/111 |
| 5,702,331 | A | 12/1997 | Perham | 482/111 |
| 6,120,336 | A * | 9/2000 | Kawai et al. | 441/64 |
| 6,364,728 | B1 * | 4/2002 | Viale et al. | 441/64 |
| 6,540,647 | B2 | 4/2003 | Spooner et al. | 482/55 |
| 6,843,693 | B2 * | 1/2005 | McCarthy | 441/64 |

* cited by examiner

*Primary Examiner*—Ed Swinehart
(74) *Attorney, Agent, or Firm*—Black Lowe & Graham PLLC

(57) ABSTRACT

An aquatic device is usable in an aquatic environment for a variety of purposes, such as physical therapy, rehabilitation, and/or exercise. The aquatic device permits a person to simulate a walking or running gait cycle in the aquatic environment, reducing the stress/strain associated with walking or running on the ground. An aquatic device includes a foot-receiving member rotationally coupled to a fin member. The fin member, when in an extended position, provides increased resistance as the person attempts to walk or run in the aquatic environment. During a walking or running gait, the fin member moves into a folded position, thus reducing the resistance of the water on the aquatic device. The aquatic device is adaptable and modifiable to have varying shapes, designs, sizes, resistance levels, and/or other aspects.

13 Claims, 7 Drawing Sheets

VARIABLE RESISTANCE AQUATIC DEVICE AND METHODS OF USING THE SAME

BACKGROUND OF THE INVENTION

1. Field of the Invention

The invention generally relates to an aquatic device for use in an aquatic environment.

2. Description of the Prior Art

Swimming appliances with extended fins for propelling a swimmer faster and more efficiently through the water have existed for years. For example, U.S. Pat. No. 1,745,280 discloses a devise having a fin or blade attached to the bottom of each foot. The device cooperates with the movement of the feet up and down in the water to propel the swimmer, similar to the function of a fish's tail.

U.S. Pat. No. 2,094,532 discloses a swimmer's appliance or shoe that employs a blade or fin coupled to a sole piece. A coiled spring and flexible cords cooperate to control the movement of the blade as the water pressure on the blade fluctuates during swimming. For this particular swimmer's appliance, the water pressure on the blade increases as the swimmer moves his or her foot forward through the water.

More recently, swimming appliances have been developed, not with the goal of making the swimmer go faster in the water, but with the goal of providing rehabilitative resistance when a wearer of the device moves in the water. U.S. Pat. No. 6,540,647 discloses a platform, a foot restraint attached to the platform, a first side wing pivotally attached to the platform, a second side wing pivotally attached to the platform opposite of the first side wing, a first end wing pivotally attached to the platform between the first side wing and the second side wing, and a second end wing opposite of the first end wing. During downward movement within the water, the wings are extended outwardly to create an increased surface area, which increases the resistance to the downward movement. During upward movement within water, the water pressure collapses the wings to make the device more hydrodynamic and thus reduce the resistance to the upward movement. The described device is a water rehabilitation device that mimics the up and down resistance of a stair-stepper machine without the bodily impacts and forces.

At least one drawback of the aforementioned appliances is that they only provide a training or rehabilitative benefit to the person as long as the person is either swimming or moving their legs directly up and directly down (i.e., stair stepping) in the water. This restricted range of motion limits the types of training and/or rehabilitative activities that can be done in the water. Consequently, it would be desirable to provide a training and/or rehabilitative device that could be used in combination with or as an alternative to other types of swimming appliances while providing a variety of new and different ways to train and/or do rehabilitative therapy in the water.

BRIEF SUMMARY OF THE INVENTION

The embodiments described herein are generally directed to an aquatic device that can be used in an aquatic environment for a variety of purposes, for example for physical therapy, rehabilitation, and/or exercise. The aquatic device permits a person to simulate, replicate, or mimic a walking or running gait cycle in the aquatic environment, reducing the stress/strain associated with walking or running on the ground. The aquatic device is adaptable and modifiable to have varying shapes, designs, sizes, resistance levels, and/or other aspects.

In one aspect, an aquatic device includes a foot-receiving member having a foot compartment and a leading edge surface, the foot compartment positioned aft of the leading edge surface; a first surface positioned proximate to at least a portion of the leading edge surface; a fin member having an upper surface, a lower surface, and a trailing edge surface, the fin member rotationally coupled to and extending from the foot-receiving member; and a second surface positioned proximate to at least a portion of the trailing edge surface, wherein the trailing edge surface of the fin member is contiguous with the leading surface of the foot-receiving member when a first force acting on the bottom surface of the fin member exceeds a first counterforce acting on the top surface of the fin member, and wherein the second surface of the fin member is contiguous with the first surface of the foot-receiving member when a second force acting on the top surface of the fin member exceeds a second counterforce acting on the bottom surface of the fin member.

In another aspect, an aquatic device includes a foot-receiving member having a foot compartment and a leading edge surface, the foot compartment positioned aft of the leading edge surface; a first surface positioned proximate to at least a portion of the leading edge surface; a fin member having a trailing edge surface, the fin member rotationally coupled to and extending from the foot-receiving member, the fin member movable between an extended position and a folded position; and a second surface positioned proximate to at least a portion of the trailing edge surface, wherein the trailing edge surface of the fin member is contiguous with the leading edge surface of the foot-receiving member when the fin member is in the extended position, and wherein the second surface of the fin member is contiguous with the first surface of the foot-receiving member when the fin member is in the folded position.

In yet another aspect, a method for simulating a gait in an aquatic environment includes moving an aquatic device downward through the aquatic environment, the aquatic device having a foot-receiving member rotationally coupled to a fin member, wherein moving the aquatic device downward urges a trailing edge surface of the fin member against a leading edge surface of the foot-receiving member; and moving the aquatic device upward through the aquatic environment wherein a first surface, which is positioned adjacent to and at a first angle relative to the leading surface of the foot-receiving member, is urged against a second surface, which is positioned adjacent to and at a second angle relative to the trailing edge surface of the fin member.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

Figure 1:
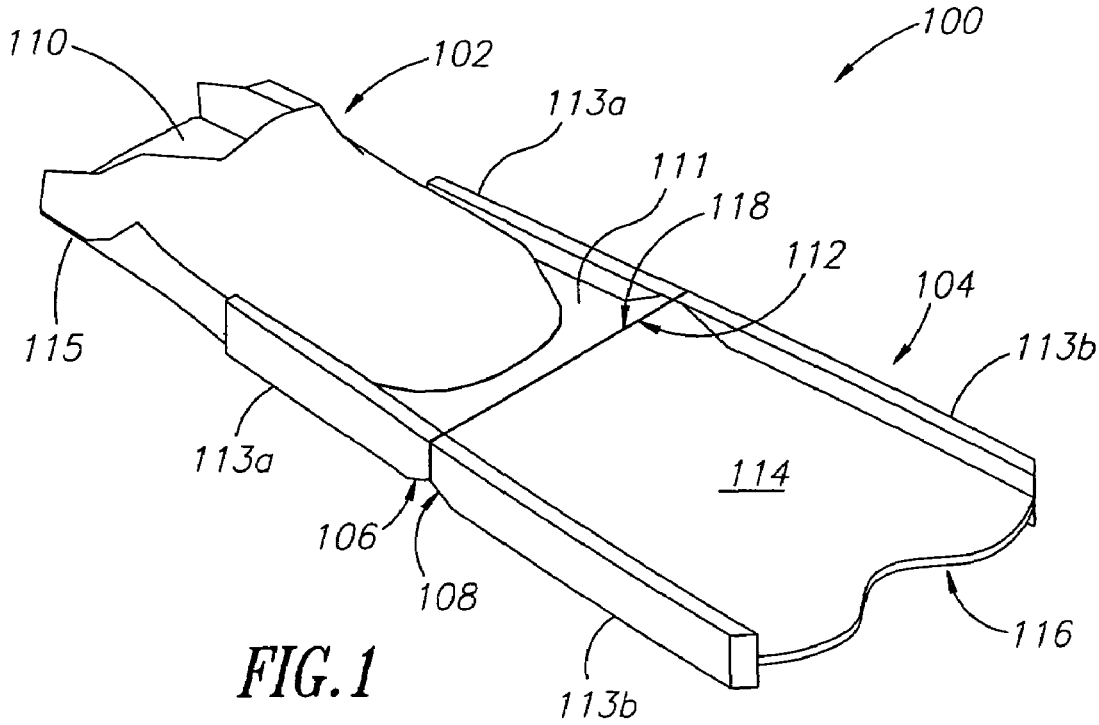
FIG. 1 is a top, right, isometric view of an aquatic device having sidewalls and in an extended position, according to the illustrated embodiment.

In the following description, certain specific details are set forth in order to provide a thorough understanding of various embodiments of the invention. However, one skilled in the art will understand that the invention may be practiced without these details. In other instances, well-known structures associated with aquatic fins and methods of using the same have not been shown or described in detail to avoid unnecessarily obscuring the description.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the claimed invention.

This description generally relates to an aquatic device that can be used in an aquatic environment for a variety of purposes, for example physical therapy, rehabilitation, and/or exercise. In one embodiment, the aquatic device permits a person to run in the water to strengthen muscles while reducing impact on joints, which may be part of a therapeutic or rehabilitative regimen after an injury, particularly in the foot, leg, knee, pelvic, and/or back region. In another embodiment, the aquatic device can benefit persons training for a sport, exercising to loose weight, or wanting to improve their overall fitness.

Biomechanics of Human Gait Cycle and Possible Advantages of Aquatic Device

Before describing the embodiments of the invention, a brief discussion of the biomechanics of a human gait cycle is provided. The normal human gait cycle is composed of a stance phase and a swing phase. In general, the stance phase comprises initial contact (heel strike), loading, mid stance, terminal stance, and pre-swing (ending in toe-off). The swing phase comprises an initial, mid, and terminal swing.

It is understood that the majority of energy transfer associated with walking or running occurs during the stance phase, in particular during initial contact and loading. During this time, the kinetic and/or gravitational (inertial) energy of the person is converted to heat, noise, and/or strain energy upon impact of the foot or feet with the ground or other medium. The strain energy is absorbed by a combination of the person's body (e.g., muscles and joints) and the ground or other medium.

In an aquatic environment when compared to an air environment, an additional amount of loading and/or resistance is imparted to the body during both the stance phase and the swing phase. The additional loading occurs because the drag (i.e., resistance to motion) from the water, for example, is much greater than the drag or resistance from the air. Further, the amount of energy transferred to the body during the stance phase is decreased in the aquatic environment primarily because the buoyancy effect of the water counteracts gravity.

It is understood and appreciated that a person moving their bare foot or feet through the water would encounter much less resistance than if their foot or feet were contained in some type of fin device. These fin devices are typically configured to enhance a kicking stroke of a swimmer, thus allowing the swimmer to achieve a more efficient and powerful stroke when trying to accelerate through the water. With these types of fin devices, however, the resistance is generally equal when flexing or extending the leg, which is in contrast to resistance or loading cycle when walking or running on ground.

Accordingly, one possible advantage of the aquatic devices and methods described and claimed herein is that a person may substantially replicate or mimic a walking and/or running gait cycle in an aquatic environment, e.g., a swimming pool, lake, etc. In addition, the aquatic devices and methods may provide many of the benefits associated with running, to include strengthening the muscles in a similar manner, while reducing wear and tear on the body, specifically on the joints. Alternatively or additionally, the aquatic device may help people to lose weight and minimize injury by permitting the user of the device to achieve a good cardiovascular workout while reducing the amount of stress/strain in the muscles, joints, and/or other tissue. Yet another advantage of the aquatic device permits persons with bad (i.e., injured, deteriorated, arthritic, etc.) joints or with recently repaired joints (e.g., joints that have been surgically repaired, such as anterior cruciate ligament (ACL) reconstruction) to strengthen the muscles associated with walking and/or running in a low impact, aquatic environment. For recently repaired joints, for example, the aquatic device may further help the person to accelerate the range of motion, flexibility, and the overall healing process of the joint.

The Aquatic Device

Figure 4:
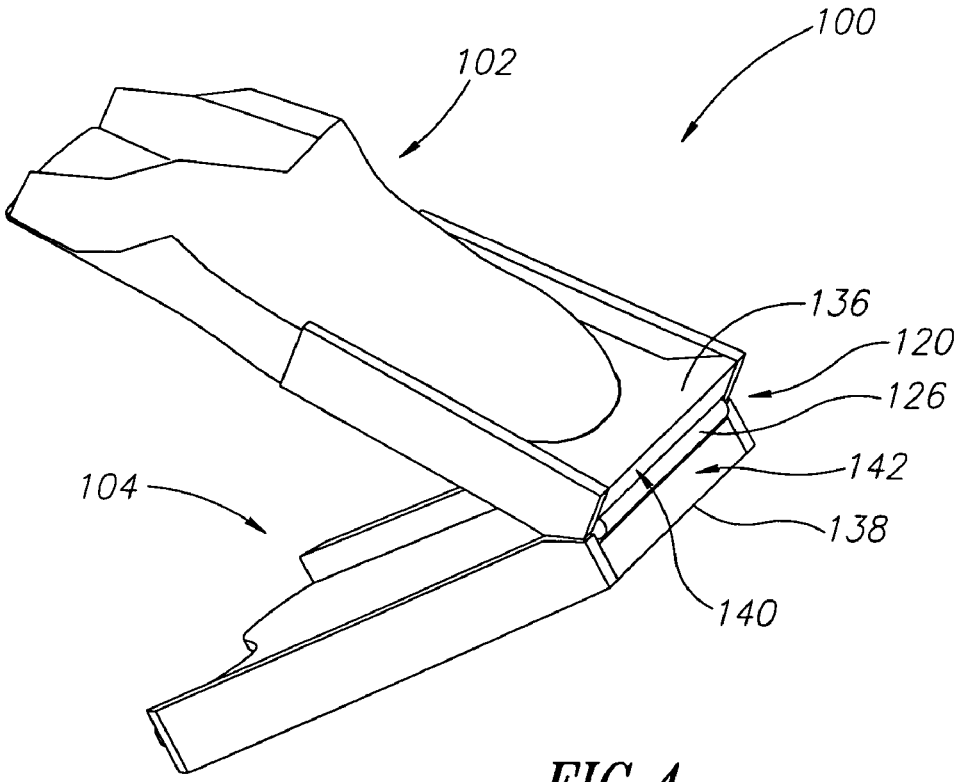
FIG. 4 is a top, right, isometric view of the aquatic device of FIG. 1 in a folded position, according to the illustrated embodiment.

FIG. 1 shows an aquatic device 100 having a foot-receiving member 102, a fin member 104, a first surface 106, and a second surface 108, according to one illustrated embodiment. The foot-receiving member 102 includes a foot compartment 110 and at least a leading edge surface 112. A portion 111 of the foot-receiving member 102 may operate as a fin, thus increasing the surface area of the foot-receiving member 102. The fin member 104 includes an upper surface 114, a lower surface 116, and at least a trailing edge surface 118. The foot-receiving member 102 is rotationally coupled to the fin member 104 such that the fin member 104 is moveable between a first or extended position, which is shown in FIG. 1, and a second or folded position, which is shown in FIG. 4.

The foot-receiving member 102 and the fin member 104 may be made of similar or different kinds of rubber or plastic materials. In one embodiment, the foot-receiving member 102 is made from a soft, pliable, and possibly stretchable material to allow a person to comfortably insert their foot and yet remain snug while being worn. The fin member 104 may be made from a stiff rubber and/or hard plastic material so that the fin member 104 does not bend under applied and repetitive loading.

Both the foot-receiving member 102 and the fin member 104 may include attached or integrally molded reinforcing stiffening members 113*a*, 113*b* (i.e., illustrated as sidewalls) to increase the overall strength and/or stiffness of the foot-receiving member 102 and/or the fin member 104. In the illustrated embodiment, the first surface 106 may include a portion of the lower surface 115 of the foot-receiving member 102 and a portion of the sidewall 113*a*. In a similar manner, the second surface 108 may include a portion of the lower surface 116 of the fin member 104 and a portion of the sidewall 113*b*.

The sidewalls 113*a*, 113*b* located on the foot-receiving member 102 and on the fin member 104, respectively, can increase the bending strength and/or stiffness of these components. The thickness and height of the sidewalls 113*a*, 113*b* are two parameters, for example, that can be selected and/or modified to increase or decrease the flexibility and/or strength of the fin member 104. As will be described in greater detail below, the foot-receiving member 102 and/or the fin member 104 can vary in thickness along the length. In one embodiment, the thickest portion of the foot-receiving member 102 is near the leading edge surface 112, and the thickest portion of the fin member 104 is near the trailing edge surface 118. The overall surface area of the aquatic device 100 and particularly the surface area of the fin member 104 may primarily provide the desired resistance in the aquatic environment.

Figure 2:
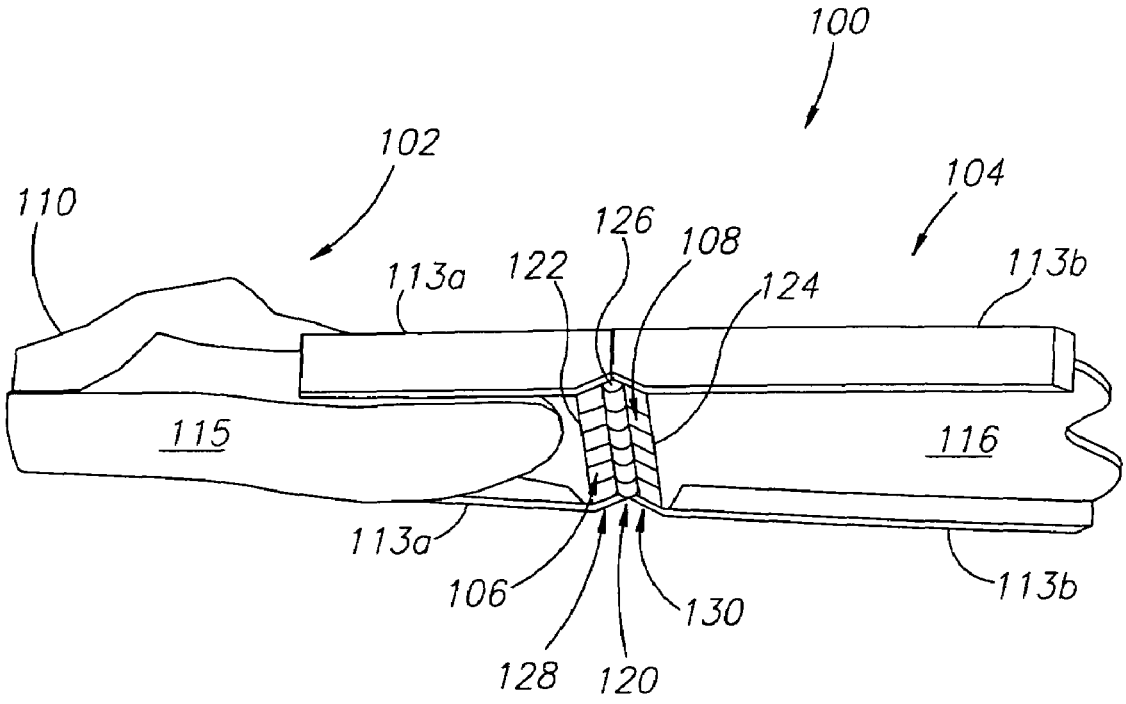
FIG. 2 is a bottom isometric view of the aquatic device of FIG. 1 showing a hinge mechanism.

FIG. 2 shows the aquatic device 100 having a hinge mechanism 120, according to one illustrated embodiment. The hinge mechanism 120, as illustrated, operates similar to a common door hinge with a first plate 122 attached to the foot-receiving member 102 and a second plate 124 attached to the fin member 104. The first plate 122 and the second plate 124 rotate about a pin 126, thus allowing the fin member 104 to rotate relative to the foot-receiving member 102. The pin 126 and the plates 122, 124 can be made from materials similar to those described above or can be made from other materials, such as from metals like aluminum or corrosion resistant steel, commonly referred to as CRES.

In this illustrated embodiment and depending on the thickness of the first plate 122, the first surface 106 may include the surface of the first plate 122 and the corresponding surface 128 of the sidewalls 113*a*. Likewise and depending on the thickness of the second plate 124, the second surface 108 may include the surface of the second plate 124 and the corresponding surface 130 of the sidewalls 113*b*.

Figure 3:
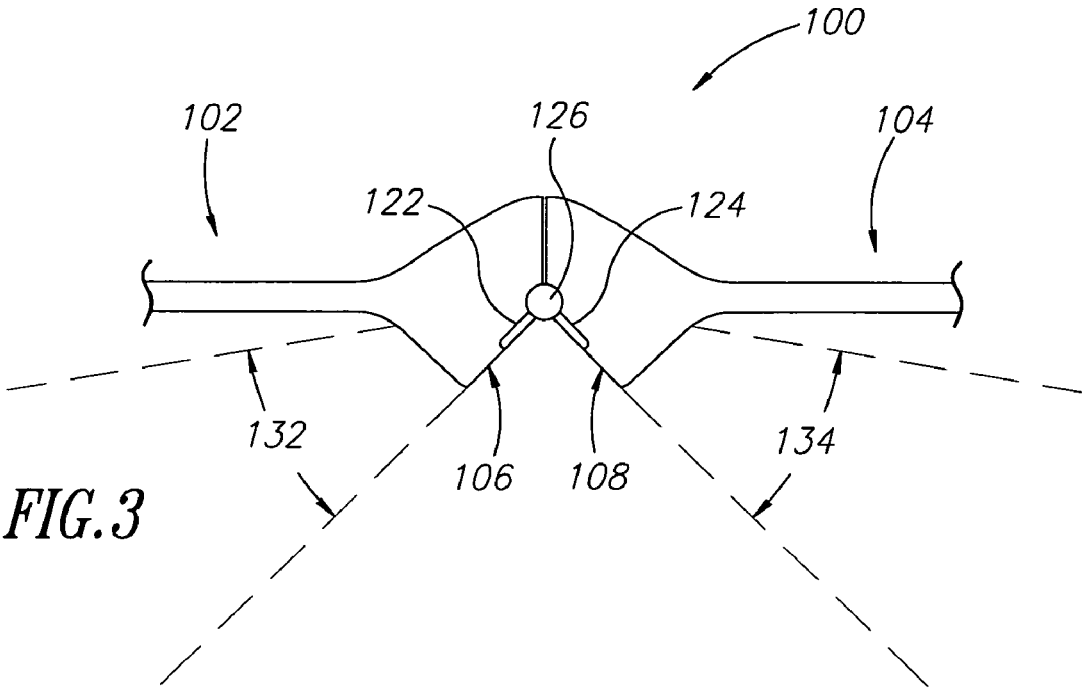
FIG. 3 is a side, elevational expanded view of the respective angles of a first surface and a second surface of the aquatic device of FIG. 1 relative to hinge rotation centerline, according to another illustrated embodiment.

FIG. 3 shows that an angle 132 of the first surface 106 can be in the range of about 45 to 85 degrees from the leading edge surface 112 of the foot-receiving member 102 and an angle 134 of the second surface 108 can have equal and opposite proportions, e.g., range from about 45 to 85 degrees from the trailing edge surface 118 of the fin member 104. In one exemplary embodiment, the angles 132, 134 are each 45-degrees, respectively; therefore the fin member 104 is positioned at approximately a 90-degree angle when in the folded position, which occurs during the swing phase of the gait. As is further shown, the first and second plates 122, 124 of the hinge mechanism 120 may be recessed in the foot-receiving member 102 and the fin member 104, respectively.

FIG. 4 shows the aquatic device 100 in the folded position. Specifically, the fin member 104 is rotated downward and relative to the foot-receiving member 102. The foot-receiving member 102 includes a first wedge section 136 proximate the hinge mechanism 120 and the fin member 104 includes a second wedge section 138 proximate the hinge mechanism 120. The wedge sections 136, 138 can be molded and/or integrally formed with the foot-receiving member 102 and the fin member 104, respectively. The wedge sections 136, 138 provide the aquatic device 100 with increased strength and stability near the hinge mechanism 120. In addition, the wedge sections 136, 138 each include contact surfaces 140, 142 to transfer load from the fin member 104 directly to the foot-receiving member 102 via compression when the aquatic device 100 is in an extended position. In addition, the surfaces 140, 142 may comprise a relatively thick part or the thickest part of the foot-receiving member 102 and the fin member 104, respectively and also be positioned approximately over a center of rotation and/or hinge centerline of the pin 126. As will be described in greater detail below regarding the operation of the aquatic device 100, it is understood that the fin member 104 will be forced upward, placing the hinge mechanism 120 in compression and the wedge sections 136, 138 in compression, when the person is stepping forward and downward during the stance phase of walking or running in the aquatic environment.

The wedge sections 136, 138 will typically be structurally identical or substantially similar. For purposes of brevity, only the wedge section 138 of the fin member 104 will be described in detail. The wedge section 138 of the fin member 104, for example, can be an increased thickness portion of the fin member 104. The fin member 104 can vary in thickness with the thickest portion near the hinge mechanism 120.

Figure 5:
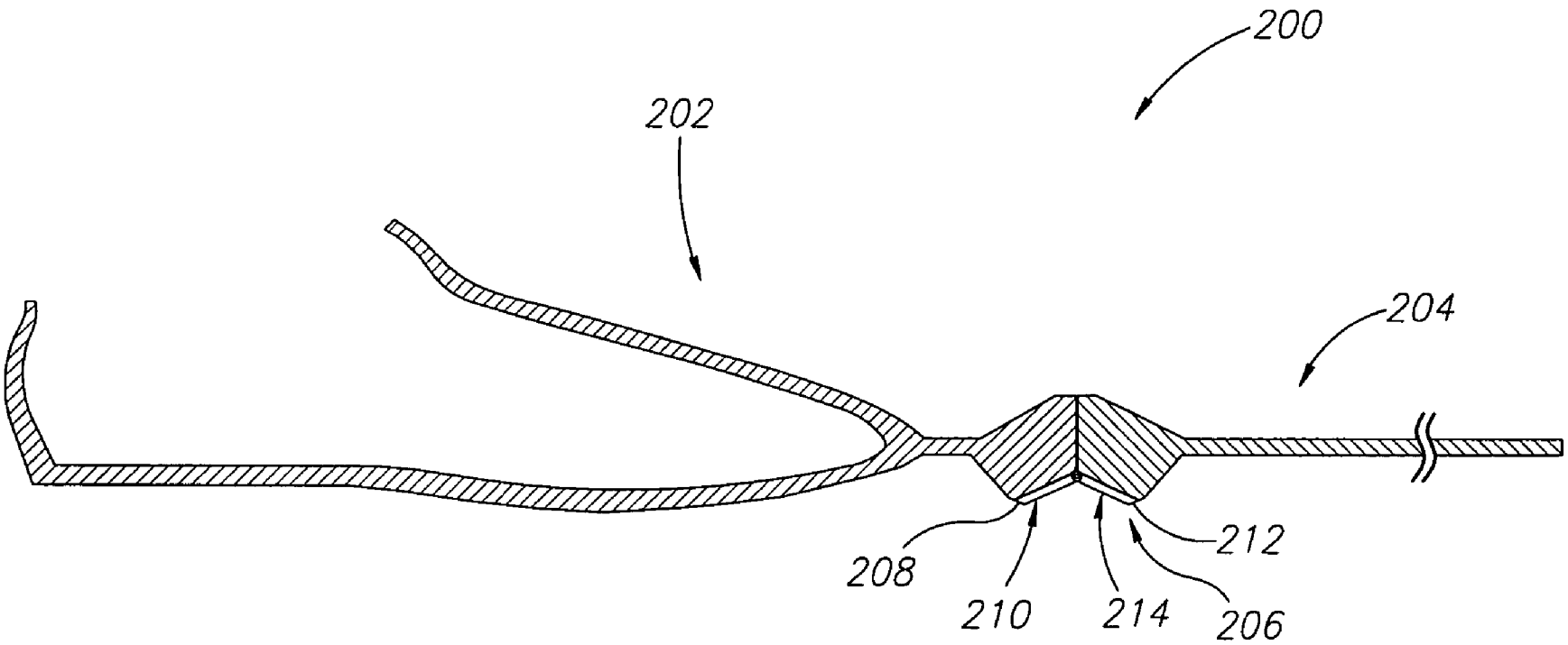
FIG. 5 is a side, elevational view of an aquatic device in an extended position without sidewalls, according to another illustrated embodiment.

FIG. 5 shows an alternate embodiment of an aquatic device 200, without the sidewalls 113*a*, 113*b*, and having a foot-receiving member 202, a fin member 204, and a hinge mechanism 206. In the illustrated embodiment, a first plate 208 of the hinge mechanism 206 extends widthwise from one side of the foot-receiving member 202 to the other. Accordingly, a first surface 210 of the aquatic device 200 is the same as the surface of the first plate 208. Similarly, a second plate 212 extends widthwise from one side of the fin member 204 to the other. Thus, a second surface 214 of the aquatic device 200 is the same as the surface of the second plate 212.

Figure 6:
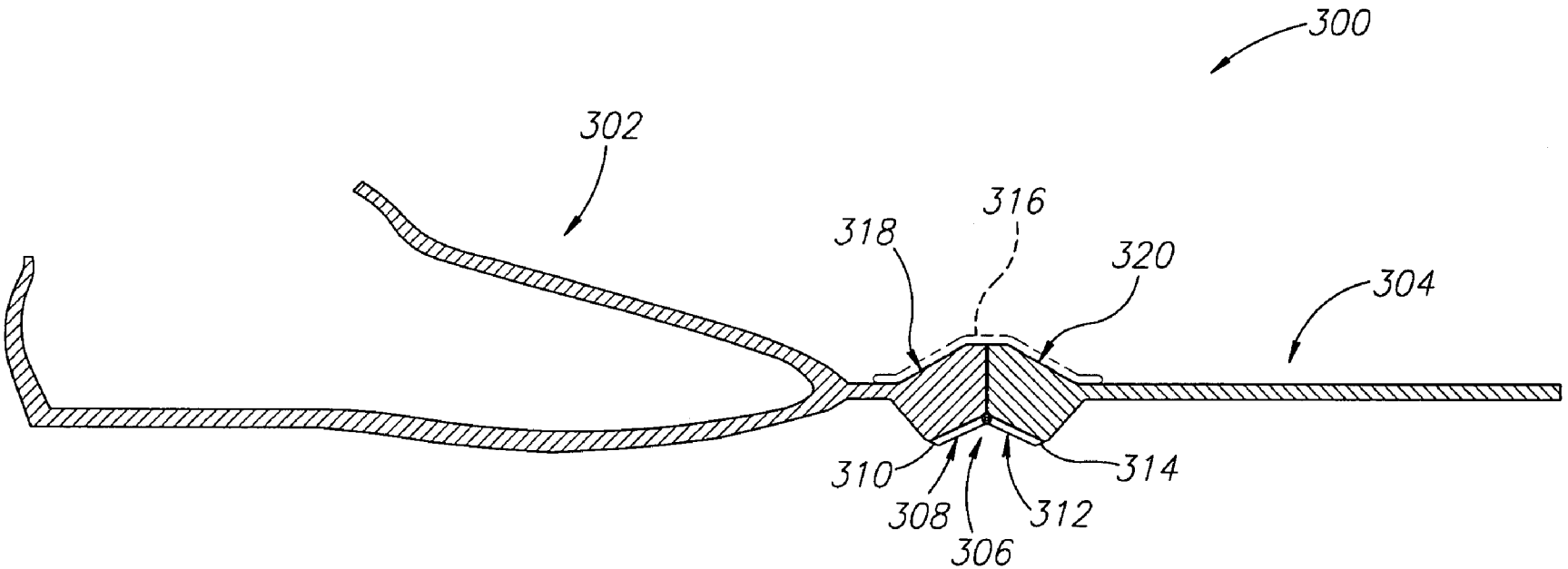
FIG. 6 is a side, elevational view of an aquatic device in an extended position without sidewalls and with an elastic hinge, according to another illustrated embodiment.

FIG. 6 shows another embodiment of an aquatic device 300 without sidewalls and including a foot-receiving member 302 and a fin member 304. The foot-receiving member 302 is rotationally coupled to the fin member 304 through an elastic hinge 306. The elastic hinge 306 can be made from rubber, plastic, or other equivalent materials as long as permits the fin member 304 to repetitively rotate, under load, relative to the foot-receiving member 302. The elastic hinge 306 can be bonded, molded, or fastened to the foot-receiving and fin members 302, 304, respectively. A first surface 308 of the aquatic device 300 comprises the exposed surface of the portion 310 of the elastic hinge 306 that is coupled to the foot-receiving member 302. A second surface 312 of the aquatic device 300 comprises the exposed surface of the portion 314 of the elastic hinge 306 that is coupled to the fin member 304. Additionally or alternatively, an optional or alternate elastic hinge 316 may be positioned on the surfaces 318, 320 of the foot-receiving member 302 and the fin member 304, respectively.

Operation of the Aquatic Device

Figure 7A:
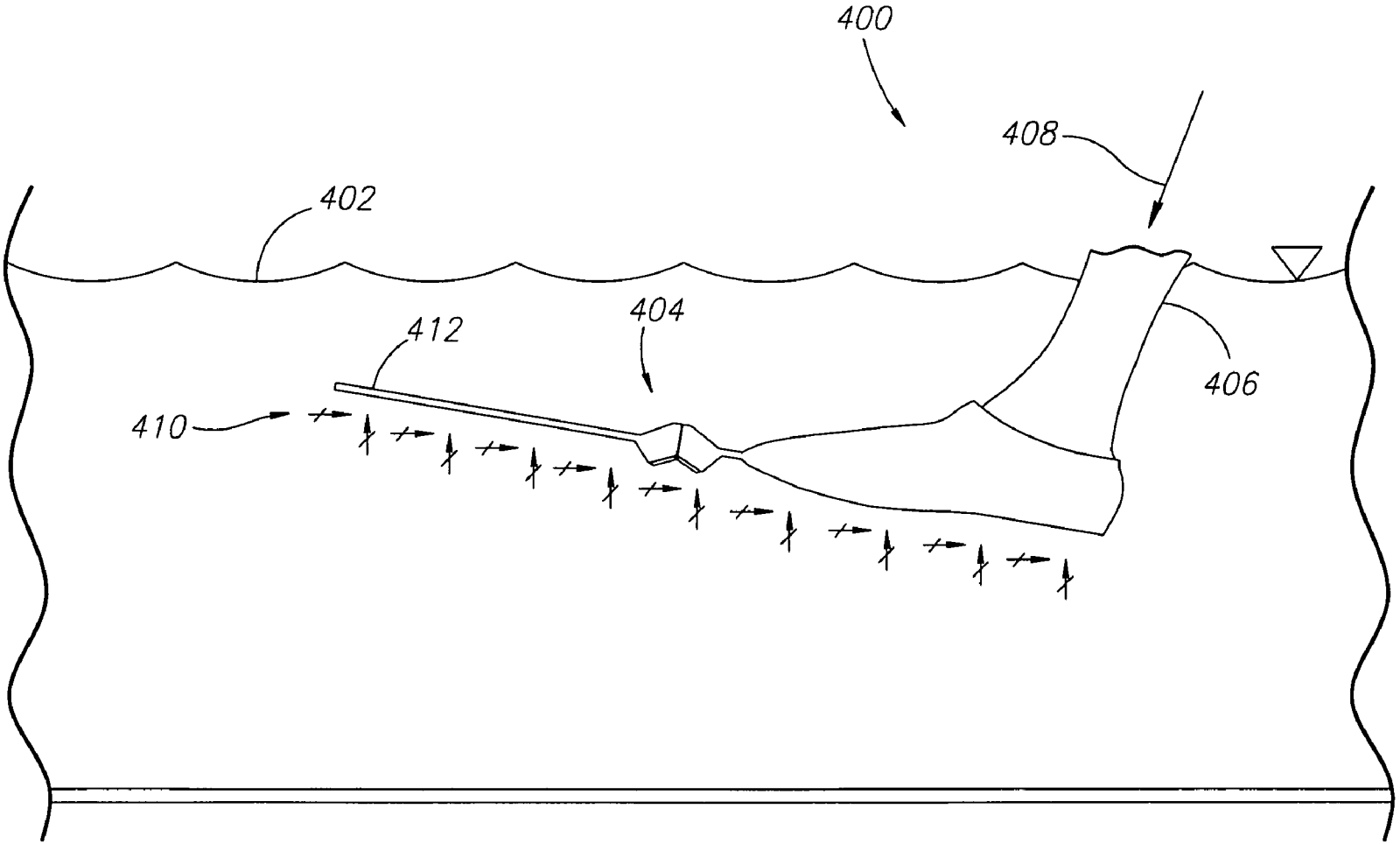
FIG. 7A is a schematic view of an aquatic device moving through a stance phase in an aquatic environment, according to one illustrated embodiment.
Figure 7B:
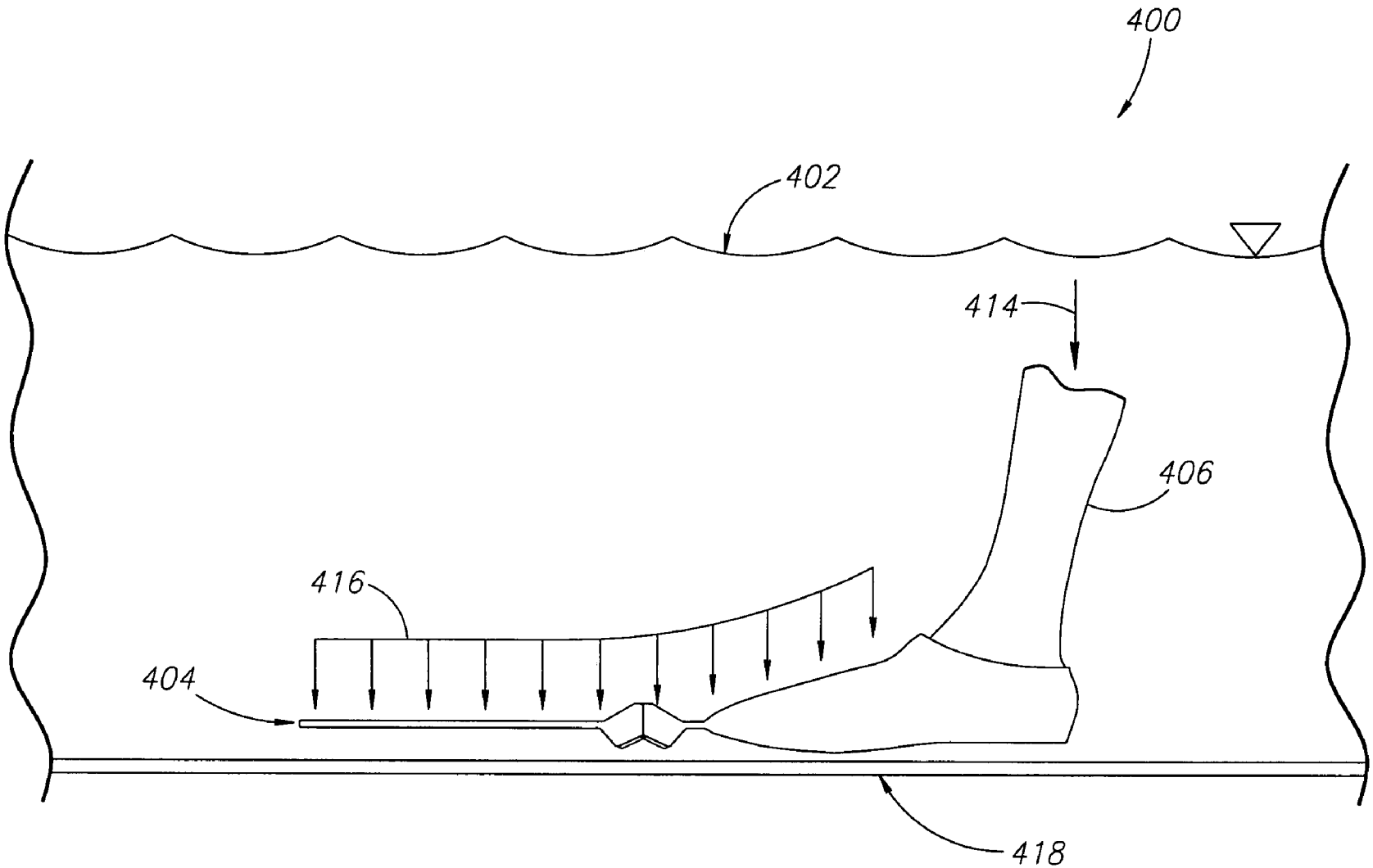
FIG. 7B is a schematic view of the aquatic device of FIG. 7A transitioning from a stance phase to a swing phase.
Figure 7C:
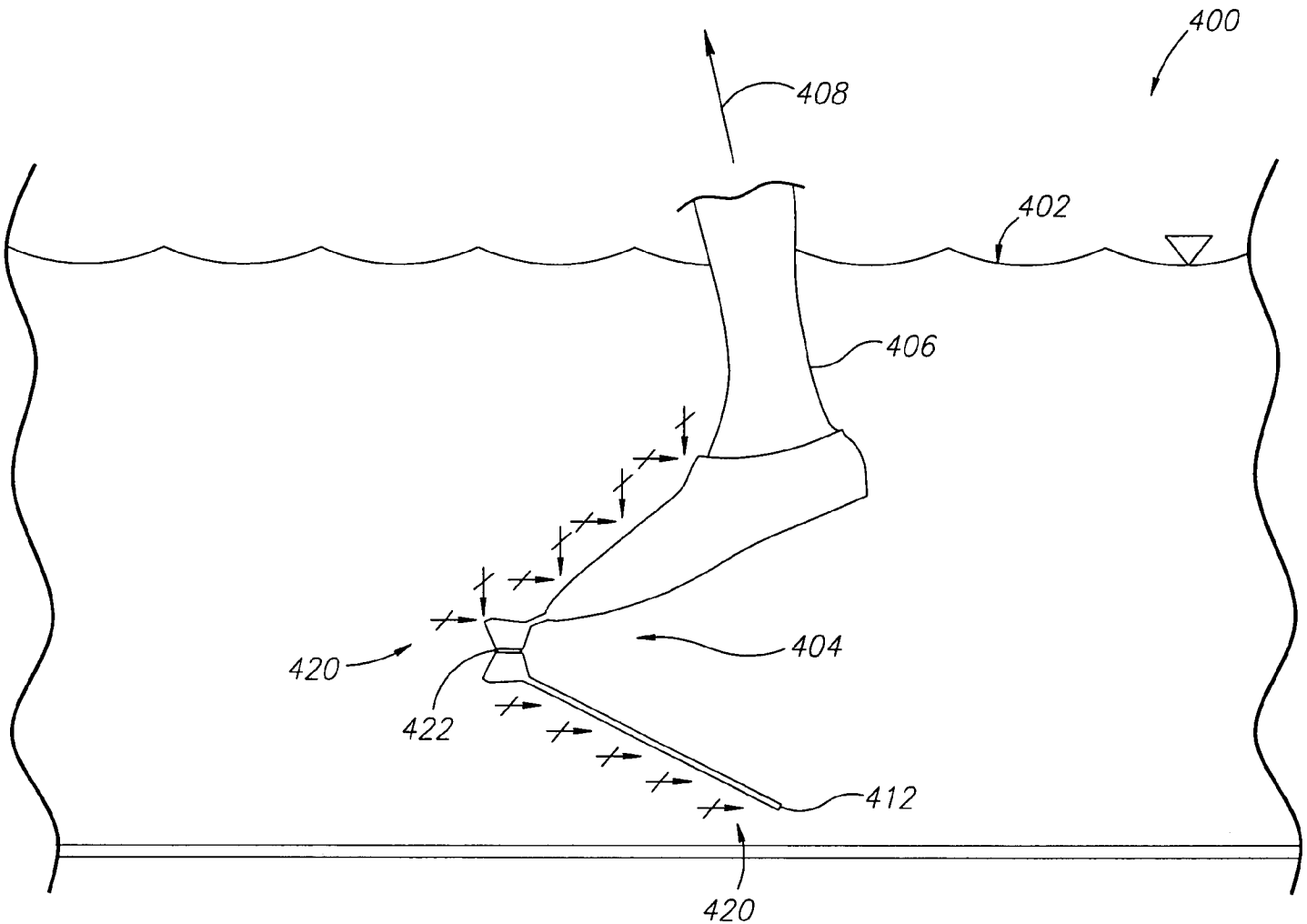
FIG. 7C is a schematic view of the aquatic device of FIG. 7A moving through a swing phase.

FIGS. 7A-7C schematically show an aquatic environment 400 where the water 402, for example, acts on an aquatic device 404 as a person 406 exercises their walking or running gait. It is understood and appreciated that the following description, in combination with FIGS. 7A-7C, involves assumptions and simplifications regarding physics, fluid dynamics, and other disciplines. Thus, the following description is provided to demonstrate the operation of the aquatic device 404 as it may be used in one type of aquatic environment 400, such as a pool.

FIG. 7A shows the commencement of the stance phase. The person 406 begins moving their leg forward and downward through the water 402, wherein the arrow 408 indicates this movement. The water 402 resists this movement, which is indicated by the plurality of vertical and horizontal force vectors 410. The force of the water 410 resisting the person's movement (i.e., drag) acts to move the fin member 412 of the aquatic device 404 into the extended position.

FIG. 7B shows the person 406 in a transition period between reaching the end of the stance phase and beginning the swing phase of their gait. In one embodiment and during at least a brief moment in time, the person's weight 414 and the water pressure 416 acting on the aquatic device 404 may be reacted by the bottom surface 418 of the aquatic environment 400 if the water level permits the person to contact the bottom surface 418 during their gait movement. In another embodiment, the aquatic device 404 permits the person to run and/or walk in the aquatic environment 400's when the level of the water is greater than the height of the person. Thus, the aquatic device 404 permits to the person to run and/or walk in the aquatic environment 400 without ever touching the bottom surface 418.

FIG. 7C shows the person 406 actively moving 408 through the swing phase of their gait. The water 402 again resists this movement, as indicated by the plurality of vertical and horizontal force vectors 420. In the illustrated embodiment, however, the resistance of the water is decreased because the fin member 412 of the aquatic device 404 is forced into the folded position. Hence, there is less surface area of the aquatic device 404 for the person 406 to urge through the water 404. The fin member 412 remains in the folded position and the resistance remains low through the swing phase and/or until the person's leg 406 reaches its maximal level of extension. This level can vary depending on the person's physical capabilities or desires. As the person 406 transitions back to the beginning of the stance phase, the fin member 412 is forced back into the extended position (FIG. 7A) and greater resistance is applied to the aquatic device 404 because of the substantially greater surface area (commonly referred as "drag area") resisting the movement of the person 406. The aforementioned operation may be repeated numerous times and at varying rates for a variety of purposes, such as rehabilitation, therapy, exercise, and/or some other purpose.

The amount of resistance the person 406 experiences may be varied. For example the amount of resistance can be directly related to the effort (speed, leg extension, etc.) of the person. Additionally or alternatively, removing and installing different sized fin members 412 may vary the amount of resistance. In one embodiment, the hinge mechanism 422 can be quickly and easily detached from the fin member 412, which permits a different sized fin member 412 to be quickly re-installed.

All of the above U.S. patents or patent applications referred to in this specification and/or listed in the Application Data Sheet are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An aquatic device comprising:

a foot-receiving member having an upper surface, a lower surface, and a foot compartment the foot-receiving member hingedly coupled to a fin member having a fin upper surface and a fin lower surface, the foot receiving member further having at least one leading edge surface extending continuously from the upper surface of the foot receiving member to the lower surface of the foot receiving member, the fin member having at least one trailing edge surface extending continuously from the fin upper surface to the fin lower surface, the trailing edge surface engageable with the leading edge surface to limit rotation of the fin member relative to the foot-receiving member by a first amount in a first direction and by a second amount in a second direction.

2. The device of claim 1 wherein the foot-receiving member includes a sidewall and wherein the leading edge surface of the foot-receiving member is located on the sidewall.

3. The device of claim 1 wherein the fin member includes a sidewall and wherein the trailing edge surface of the fin member is located, on the sidewall.

4. The device of claim 1 wherein the foot-receiving member is hingedly coupled to the fin member with a pin.

5. An aquatic device comprising:

a foot-receiving member having a foot compartment and at least one sidewall, the sidewall having a top surface, a lower surface, and a leading edge surface that extends continuously between the top surface and the lower surface of the sidewall, the leading edge surface includes an upper face and a lower face, the upper face intersects width the top surface, the lower face intersects with the upper face at a first angle and extends toward the lower surface;

a fin member rotationally coupled to the foot-receiving member, the fin member having at least one sidewall with a fin top surface, a fin lower surface, and a fin trailing edge surface that extends continuously between the fin top surface and the fin lower surface, the fin trailing edge surface includes a fin sidewall upper face and a fin sidewall lower face, the fin sidewall upper face intersects with the fin top surface, the fin sidewall lower face intersects with the fin sidewall upper face at a second angle and extends toward the fin lower surface.

6. The device of claim 5 wherein the first angle is in the range of about 45-85 degrees.

7. The device of claim 5 wherein the second angle is in the range of about 45-85 degrees.

8. The device of claim 5, further comprising:

a stiffening member attached to at least a portion of one or both of the foot-receiving member and the fin member.

9. The device of claim 5 wherein the upper face of the sidewall of the foot-receiving member contacts the fin upper face of the fin sidewall when the fin member is moved to an extended position.

10. The device of claim 5 wherein the lower face of the sidewall of the foot-receiving member contacts the fin lower face of the fin sidewall when the fin member is moved to a folded position.

11. The device of claim 5 wherein the upper face of the trailing edge surface contacts the upper face of the leading edge surface when the fin member is in the extended position.

12. The device of claim 5 wherein the lower face of the trailing edge surface contacts the lower face of the leading edge surface when the fin member is in the folded position.

13. The device of claim 5 wherein the fin member is configured to resist a downward motion when moved in a gait motion and inoperable to sufficiently generate a horizontal swimming motion.

* * * * *